US008079355B1

(12) United States Patent
Chung et al.

(10) Patent No.: US 8,079,355 B1
(45) Date of Patent: Dec. 20, 2011

(54) FIRING DEVICE OF SIDE-HANDLE BATON

(75) Inventors: Yong-Jun Chung, Taipei (TW); Wan-Ming Huang, Taipei (TW)

(73) Assignee: Jun Xuan Industrial Co., Ltd., Luzhou (TW)

( * ) Notice: Subject to any disclaimer, the term of this patent is extended or adjusted under 35 U.S.C. 154(b) by 35 days.

(21) Appl. No.: 12/829,605

(22) Filed: Jul. 2, 2010

(51) Int. Cl.
*F41B 11/00* (2006.01)

(52) U.S. Cl. ..... 124/71

(58) Field of Classification Search ..... 124/69, 124/70, 71, 72, 73, 76
See application file for complete search history.

(56) References Cited

U.S. PATENT DOCUMENTS 1,994,294 A * 3/1935 Williams, Jr. ..... 42/2
2,124,172 A * 7/1938 Wildes et al. ..... 42/2
3,830,214 A * 8/1974 Curtis ..... 124/57
3,889,652 A * 6/1975 Curtis ..... 124/41.1
4,989,358 A * 2/1991 Aronson et al. ..... 42/72
5,326,101 A * 7/1994 Fay ..... 463/47.4
5,361,524 A * 11/1994 Karkau et al. ..... 42/1.16
5,529,215 A * 6/1996 Banks et al. ..... 222/113
5,529,300 A * 6/1996 Frazier et al. ..... 463/47.4
6,463,688 B1 * 10/2002 Idehara ..... 42/1.16
7,412,975 B2 * 8/2008 Dillon, Jr. ..... 124/71
7,752,974 B2 * 7/2010 Wenaas et al. ..... 102/367
2006/0254570 A1 * 11/2006 Dillon ..... 124/69

* cited by examiner

*Primary Examiner* — Troy Chambers
(74) *Attorney, Agent, or Firm* — Rabin & Berdo, P.C.

(57) ABSTRACT

A firing device of a side-handle baton includes first and second shaft portions, a magazine portion, a trigger housing, a gas chamber portion, and a nozzle portion. Pressure from a $CO_2$ cartridge in the second shaft portion enters and accumulates in the gas chamber portion to push a nozzle. Once a pushbutton of the magazine portion is pressed, ball-shaped bullets in the magazine portion fall into a bore of the first shaft portion, and the magazine portion pushes a trigger in the trigger housing, thus driving a sear to release the nozzle. When a piston rod in the nozzle is freed, the pressure in the gas chamber portion is discharged to fire the bullets. A recoil spring then pushes the nozzle portion back to re-seal the gas chamber portion, allowing pressure to accumulate again in the gas chamber portion, and the sear to retain the nozzle until the next shot.

2 Claims, 11 Drawing Sheets

FIRING DEVICE OF SIDE-HANDLE BATON

BACKGROUND OF THE INVENTION

1. Technical Field

The present invention relates to a firing device of a side-handle baton. More particularly, the present invention relates to a firing device which takes the form of a side-handle baton and includes a first shaft portion, a second shaft portion, a magazine portion, a trigger housing, a gas chamber portion, and a nozzle portion, wherein a $CO_2$ cartridge placed in the second shaft portion serves as a pneumatic power source. By pushing a pushbutton of the magazine portion, pressure accumulated in the gas chamber portion is discharged through a nozzle, and in consequence ball-shaped bullets fallen into a bore of the first shaft portion are fired through an opening of the bore. After the one-time discharge of the pressure during the firing process, a nozzle recoil spring pushes the related mechanisms to the original equilibrium state to resume pressure accumulation in preparation for the next shot. Thus, the firing device effectively increases the practical use and fun of side-handle batons.

2. Description of Related Art

A side-handle baton is a generally T-shaped rod as shown in FIG. 1 and is widely used by the police and the military for defense and attack. Side-handle batons are also used for close quarters combat training in martial arts and serve defensive and body-strengthening purposes. However, the conventional side-handle batons are solid rods operable only in striking or swinging actions; in other words, the functions of the conventional side-handle batons are rather limited.

BRIEF SUMMARY OF THE INVENTION

In view of the limited uses of the conventional side-handle batons, the inventor of the present invention put years of practical experience in the designing and making of toys and other equipment into the research and improvement of side-handle batons and, after repeated trials and modifications, finally succeeded in developing a firing device of a side-handle baton as disclosed herein. The disclosed firing device includes an intricate firing mechanism ingeniously incorporated into the form of a side-handle baton and has been actually made and proven to be capable of loading a plurality of ball-shaped bullets and firing the bullets successively. Furthermore, the ball-shaped bullets can be easily loaded into the firing device, and a $CO_2$ cartridge serving as the power source conveniently replaced. Thus, the present invention effectively increases not only the practical value of but also the fun in using side-handle batons.

BRIEF DESCRIPTION OF THE SEVERAL VIEWS OF THE DRAWINGS

A detailed description of the structural features and actuation modes of the present invention is given below with reference to a preferred embodiment in conjunction with the accompanying drawings, in which.

DETAILED DESCRIPTION OF THE INVENTION

Figure 1:
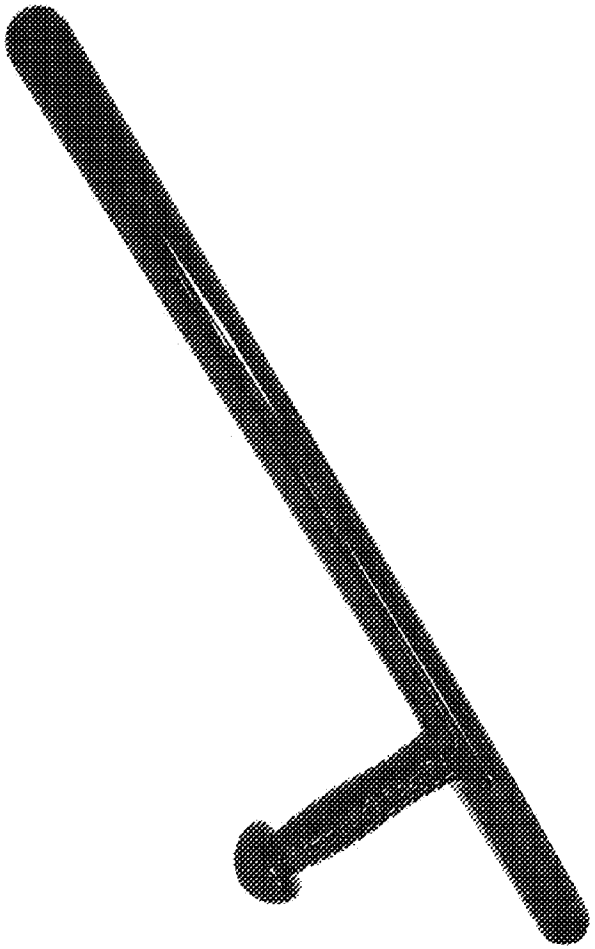
Fig. 1 (Prior Art)
FIG. 1 is a photograph of a conventional side-handle baton.
Figure 2:
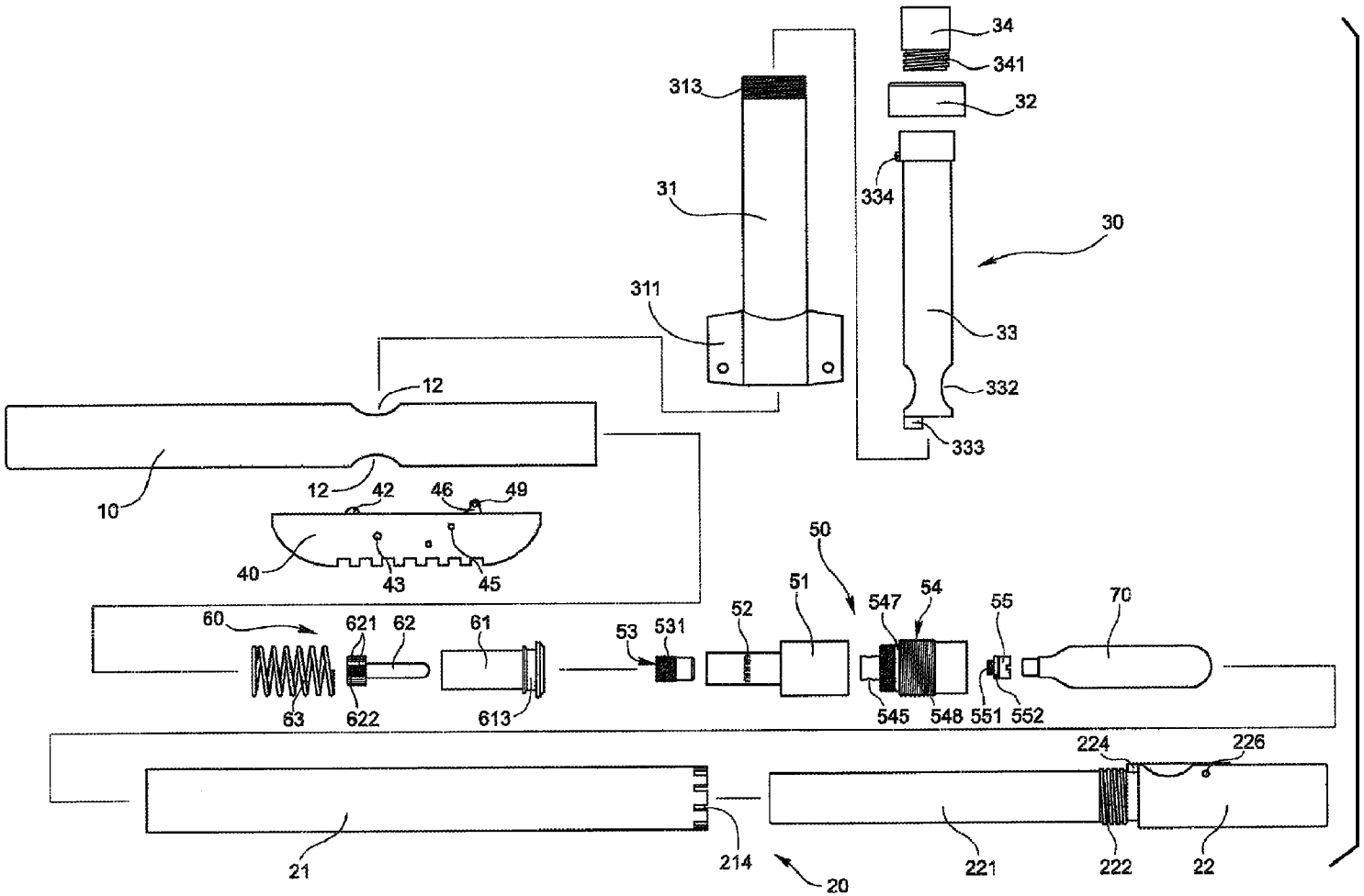
FIG. 2 is an exploded view of the present invention.
Figure 3:
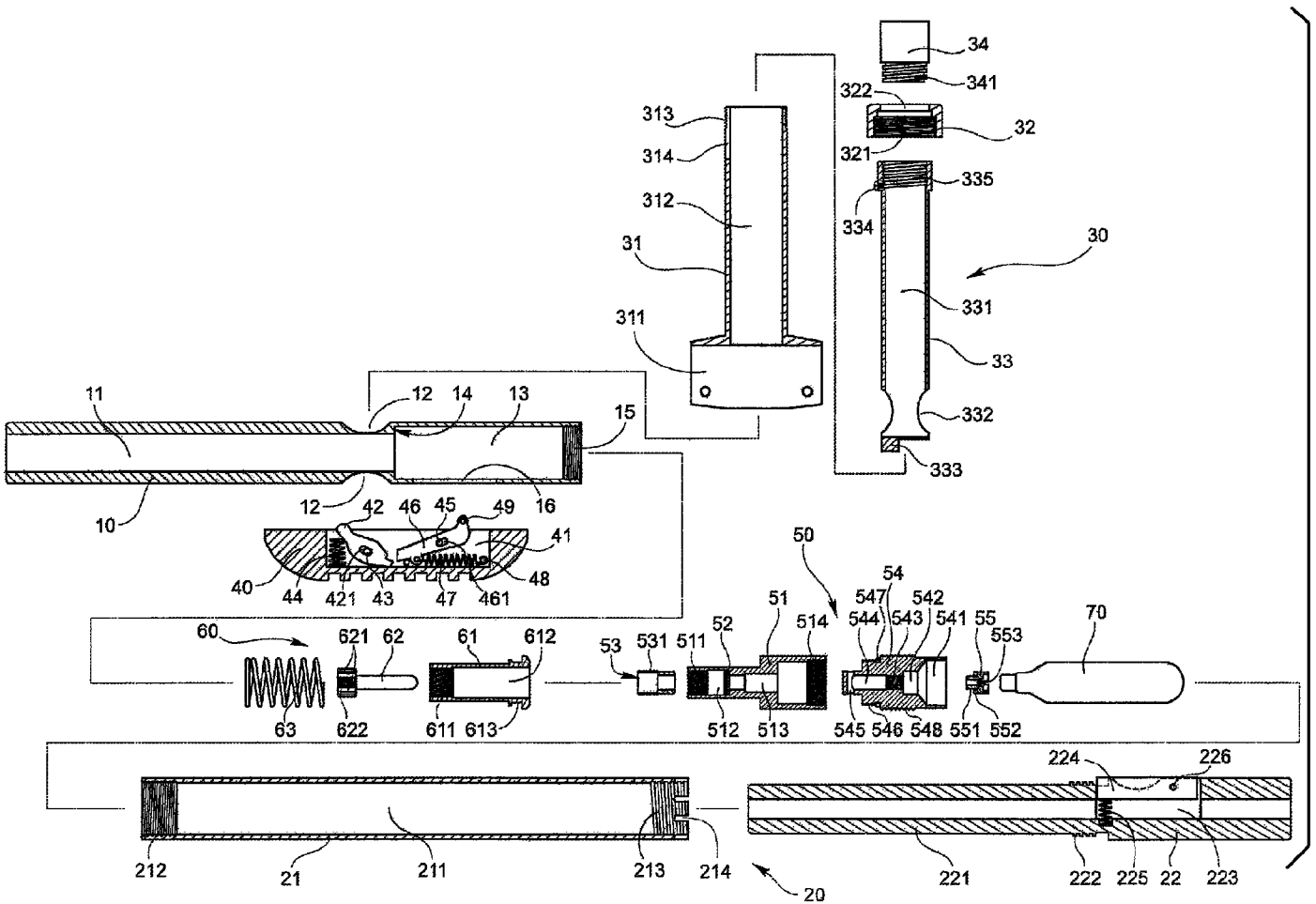
FIG. 3 is an exploded sectional view of the present invention.

Referring to FIG. 2 and FIG. 3, a firing device according to an embodiment of the present invention essentially includes a first shaft portion 10, a second shaft portion 20, a magazine portion 30, a trigger housing 40, a gas chamber portion 50, and a nozzle portion 60.

The first shaft portion 10 has a front section penetrated longitudinally by a bore 11. Also, the first shaft portion 10 is penetrated vertically by a through hole 12 located near a rear section of the first shaft portion 10. The rear section of the first shaft portion 10 is penetrated longitudinally by a receiving hole 13 which is connected with the bore 11 and has a slightly larger diameter than the bore 11 such that a shoulder 14 is formed where the bore 11 and the receiving hole 13 are connected. In addition, an internal thread 15 is provided on a rear end wall of the receiving hole 13, and a slot 16 is formed on a bottom side of the first shaft portion 10 behind the through hole 12.

The second shaft portion 20 includes a shaft 21 and a shaft cap 22. The shaft 21 has the same outer diameter as the first shaft portion 10 and is penetrated longitudinally by a passage 211. An internal thread 212 is provided on a front end wall of the passage 211 and has the same specifications as the internal thread 15 of the first shaft portion 10. Likewise, an internal thread 213 is provided on a rear end wall of the passage 211. The shaft 21 also has a rear end surface formed with a plurality of engaging grooves 214 that are angularly spaced from one another. The shaft cap 22 has an integrally formed front extension defined as a front rod 221 for being inserted in the passage 211 of the shaft 21. An external thread 222 having the same specifications as the internal thread 213 at the rear end of the shaft 21 is provided on the front rod 211 and adjacent to the shaft cap 22. The shaft cap 22 has an upper side formed with a slot 223 in which a fastening lever 224 is pivotally provided. The fastening lever 224 has a front end pushed by a spring 225 so as to be constantly level with the slot surface of the slot 223 of the shaft cap 22. The front end of the fastening lever 224 can be pressed downward or, more specifically, be rotated downward about a pivot 226 at the rear end of the fastening lever 224, thereby compressing the spring 225. When the pressing force is removed, the fastening lever 224 is pushed back to the level position by the resilient force of the spring 225.

Figure 4A:
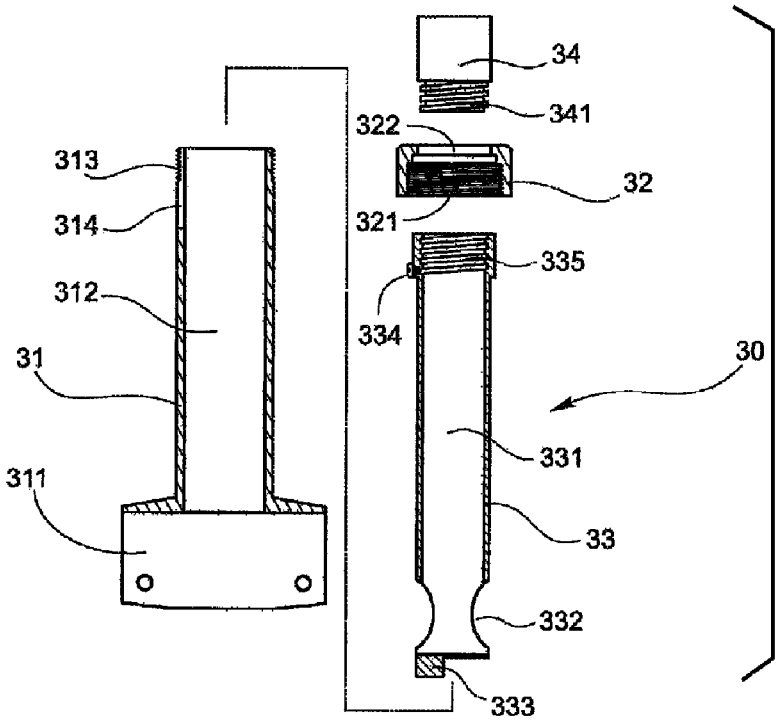
FIGS. 4A and 4B are an exploded sectional view and an assembled sectional view of a magazine portion of the present invention.
Figure 4B:
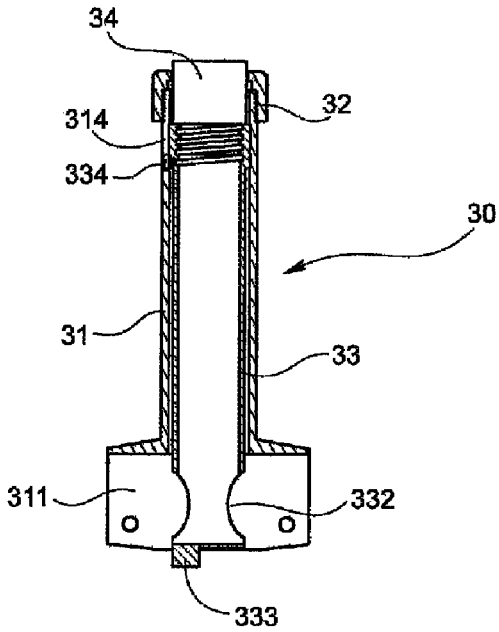
Figure 7:
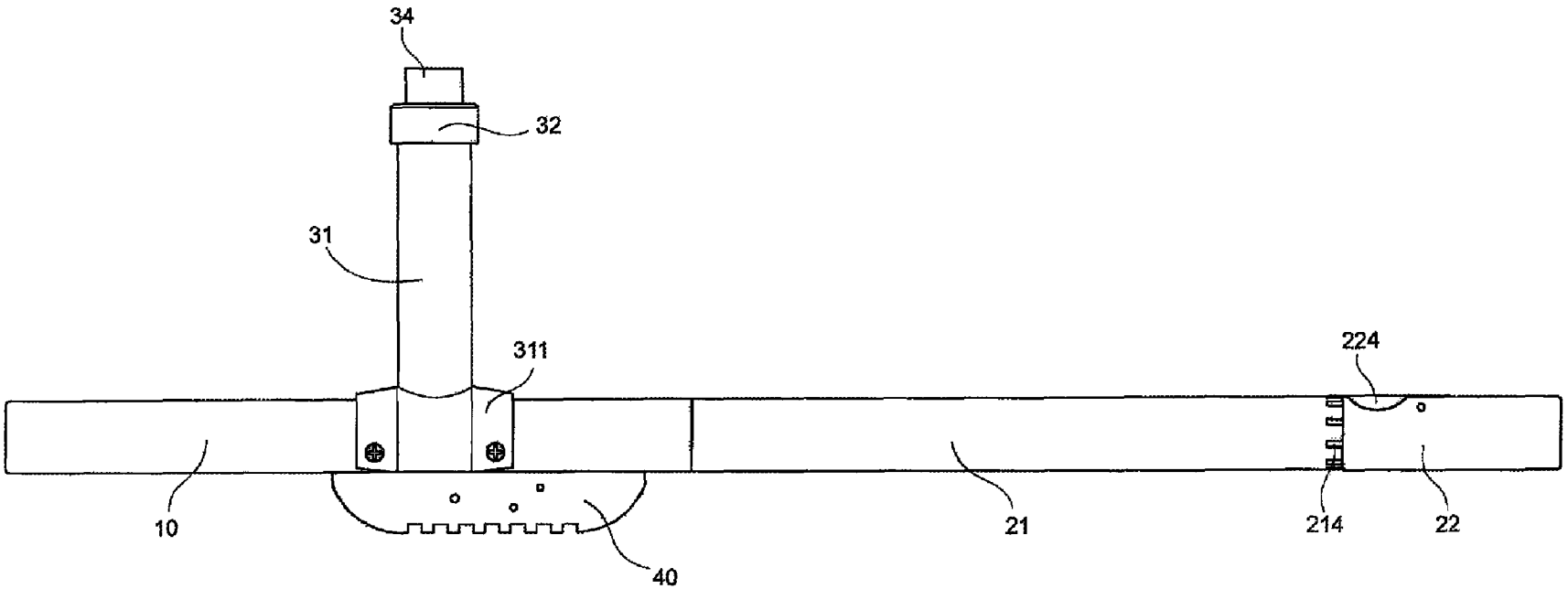
FIG. 7 is an assembled view of the present invention.
Figure 8:
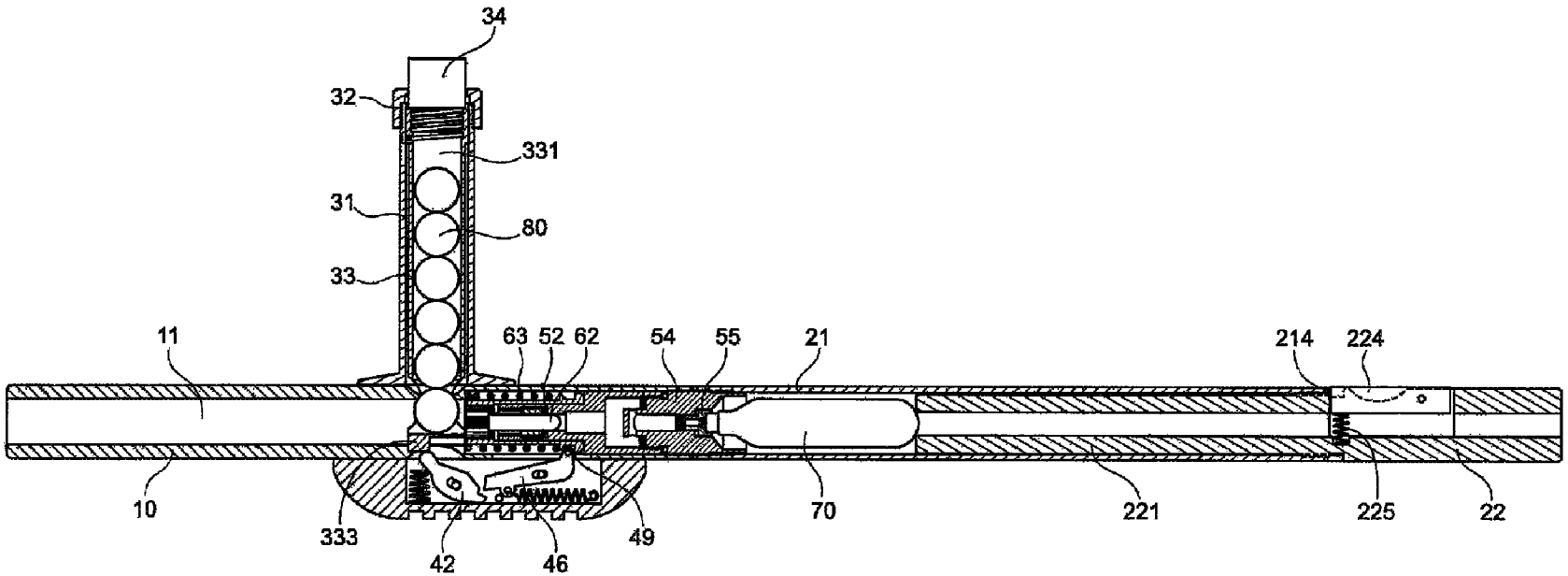
FIG. 8 is an assembled sectional view of the present invention.

Referring to FIGS. 4A and 4B, the magazine portion 30 includes a magazine seat 31, a top cover 32, a magazine body 33, and a pushbutton 34. The magazine seat 31 has a bottom portion formed as a C-shaped base 311 by which the magazine seat 31 is perpendicularly connected and secured to the first shaft portion 10 at a position corresponding to the through hole 12 located at the middle section of the first shaft portion 10, as shown in FIG. 7 and FIG. 8. The magazine seat 31 is penetrated longitudinally by a through hole 312 which, when the magazine seat 31 is connected with the first shaft portion 10, corresponds in position to and communicates with the through hole 12 of the first shaft portion 10. In addition, an external thread 313 is provided at the upper end of the magazine seat 31, and a slot 314 is formed at an appropriate position on a lateral side of the upper end of the magazine seat 31. The top cover 32 is penetrated by a hollow portion and has a lower end provided with an internal thread 321 having the same specifications as the external thread 313 at the upper end of the magazine seat 31. Besides, a through hole 322 is formed above the internal thread 321 and has a smaller diameter than the internal thread 321. The magazine body 33 is a cylindrical element penetrated longitudinally by a receiving hole 331. The magazine body 33 has a lower end penetrated transversely by a transverse through hole 332, a bottom portion protrudingly provided with a pushing block 333, and an upper end which is laterally screwed with a stop screw 334 and provided with an internal thread 335. The pushbutton 34 has a button body whose outer diameter is slightly smaller than the diameter of the through hole 322 of the top cover 32. The button body has a lower extension provided with an external thread 341 having the same specifications as the internal thread 335 at the upper end of the magazine body 33. The magazine portion 30 is assembled in the following manner. To begin with, the magazine body 33 is inserted into the through hole 312 of the magazine seat 31, with the stop screw 334 of the magazine body 33 aligned with the slot 314 of the magazine seat 31. Then, the internal thread 321 of the top cover 32 is engaged with the external thread 313 at the upper end of the magazine seat 31 such that the top cover 32 is connected to and covers the upper end of the magazine seat 31. Afterward, by engaging the external thread 341 of the pushbutton 34 with the internal thread 335 of the magazine body 33, the pushbutton 34 passes through the through hole 322 of the top cover 32 and is mounted on the upper end of the magazine body 33, with the button body of the pushbutton 34 exposed outside the top cover 32. In the resultant assembly, the relative positions of the magazine body 33 and the magazine seat 31 are limited by the stop screw 334 extending through the slot 314. Hence, the magazine body 33 is only allowed to move vertically in the magazine seat 31 by a predetermined distance and is prevented from horizontal rotation.

The trigger housing 40 is internally formed with a recess 41 and secured to the bottom of the first shaft portion 10 at an appropriate position corresponding to the through hole 12 and the slot 16. A trigger 42 is pivotally provided in a front portion of the recess 41 by means of a pivot 43, wherein the pivot 43 is received in a slide groove 421 passing through the trigger 42. A pushing spring 44 is fixedly provided below the front end of the trigger 42 such that the front end of the trigger 42 constantly rests on the pushing spring 44, protrudes slightly into the through hole 12 at the bottom of the first shaft portion 10, and thereby presses against the pushing block 333 at the bottom portion of the magazine body 33. On the other hand, a sear 46 is pivotally provided in a rear portion of the recess 41 by means of another pivot 45, wherein the pivot 45 is received in a slide groove 461 passing through the sear 46. An extension spring 47 has one end connected to the bottom of the front end of the sear 46 and the other end connected to a supporting rod 48 in the recess 41. A roller 49 is pivotally connected to a rear upper end of the sear 46 and, due to contraction of the extension spring 47, constantly protrudes into the slot 16 at the bottom of the first shaft portion 10.

Figure 5A:
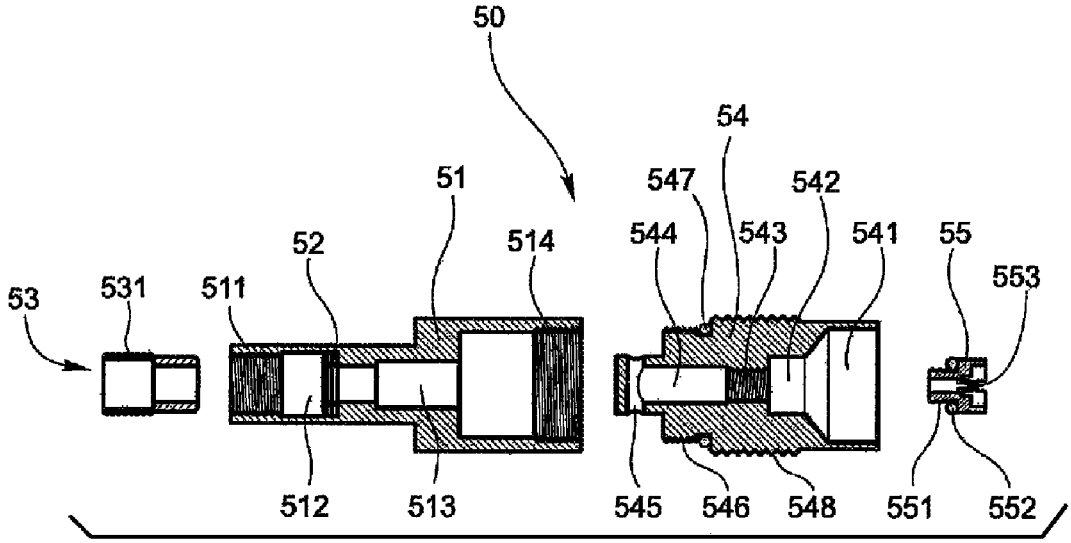
FIGS. 5A and 5B are an exploded sectional view and an assembled sectional view of a gas chamber portion of the present invention.
Figure 5B:
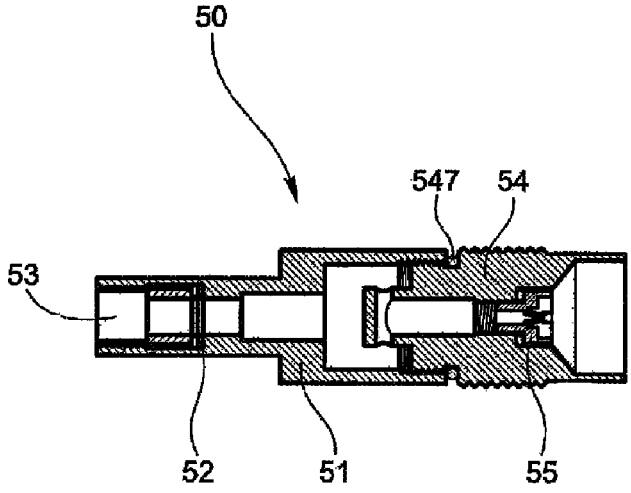

Referring to FIGS. 5A and 5B, the gas chamber portion 50 includes a gas chamber body 51, a plurality of gaskets 52, a gasket fixing member 53, a gas chamber end cap 54, and a puncturer 55. The gas chamber body 51 is penetrated longitudinally by a hollow portion, wherein the hollow portion has: a front section provided with an internal thread 511, a gasket cavity 512 adjacent to the internal thread 511, a through hole 513 following the gasket cavity 512, and a rear end provided with an internal thread 514. The gaskets 52, each being an annular washer made of a flexible and resilient plastic material, are received in the gasket cavity 512 of the gas chamber body 51. The gasket fixing member 53 is centrally and longitudinally penetrated by a hollow portion and has a front section provided with an external thread 531 having the same specifications as the internal thread 511 on a front section of the gas chamber body 51. Hence, the gasket fixing member 53 can be screwed into the section of the gas chamber body 51 that is provided with the internal thread 511, thereby pressing tightly against and fixing the gaskets 52 in position. The gas chamber end cap 54 is provided therein with a cavity 541, a puncturer hole 542, an internally threaded hole 543, and a front hole 544 which are arranged in a rear-to-front direction and sequentially connected. The front hole 544 has a wall penetrated by a through hole 545 for communication between the inside and outside of the front hole 544. The gas chamber end cap 54 has a front section provided with an external thread 546 having the same specifications as the internal thread at the rear end of the gas chamber body 51. Besides, an O-ring 547 is mounted behind and adjacent to the external thread 546. Immediately behind the O-ring 547 is an external thread 548 having the same specifications as the internal thread 15 at the rear end of the first shaft portion 10 and the internal thread 212 at the front end of the shaft 21. The gas chamber end cap 54 is connected to the rear end of the gas chamber body 51 by engagement between the external thread 546 on the front section of the gas chamber end cap 54 and the internal thread 514 at the rear end of the gas chamber body 51. The puncturer 55 is penetrated centrally and longitudinally by a hollow portion and has a front end provided with an external thread 551 having the same specifications as the internally threaded hole 543 of the gas chamber end cap 54. In addition, an O-ring 552 is mounted behind the external thread 551, and the rear end surface of the puncturer 55 is provided with a conical piercing element 553. The puncturer 55 is hermetically installed in the puncturer hole 542 of the gas chamber end cap 54 by engagement between the external thread 551 of the puncturer 55 and the internally threaded hole 543 of the gas chamber end cap 54.

Figure 6A:
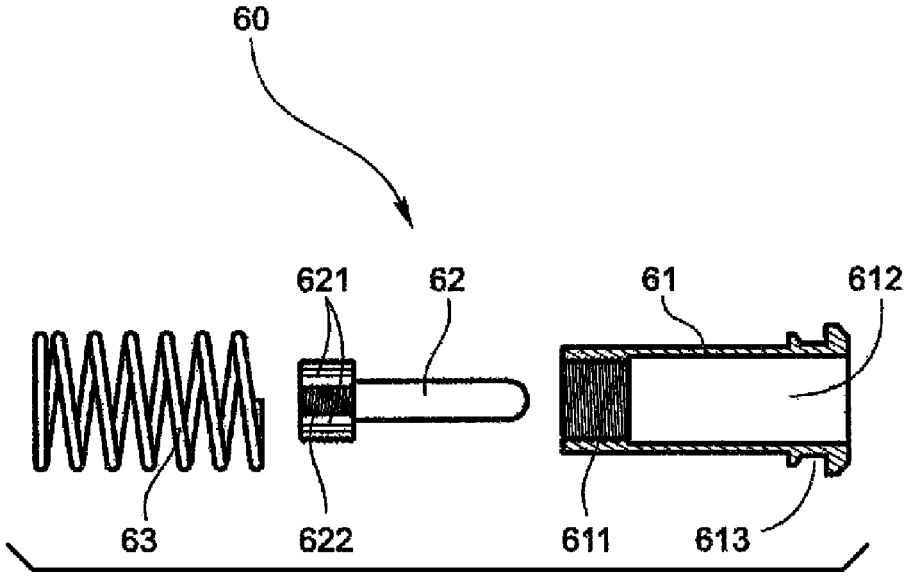
FIGS. 6A and 6B are an exploded sectional view and an assembled sectional view of a nozzle portion of the present invention.
Figure 6B:
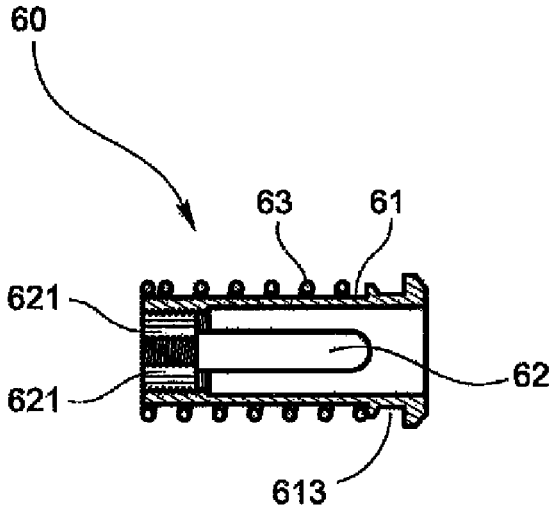

Referring to FIGS. 6A and 6B, the nozzle portion 60 includes a nozzle 61, a nozzle piston rod 62, and a nozzle recoil spring 63. The nozzle 61, which is penetrated longitudinally by a hollow portion, has a front section provided with an internal thread 611 and a rear section formed as a through hole 612 extending to a rear end opening of the nozzle 61. Besides, the rear end of the nozzle 61 is externally and circumferentially provided with an engaging groove 613. The nozzle piston rod 62 has a front end provided with an external thread 622 and peripherally formed with a plurality of channels 621, wherein the external thread 622 has the same specifications as the internal thread 611 on the front section of the nozzle 61. The nozzle piston rod 62 also has a rod portion formed with a rounded rear end. The nozzle piston rod 62 is installed in the nozzle 61 by engagement between the external thread 622 of the nozzle piston rod 62 and the internal thread 611 of the nozzle 61. The nozzle recoil spring 63 has an inner diameter greater than the outer diameter of the front section of the nozzle 61 so as to be mounted around the front section of the nozzle 61.

Figure 9:
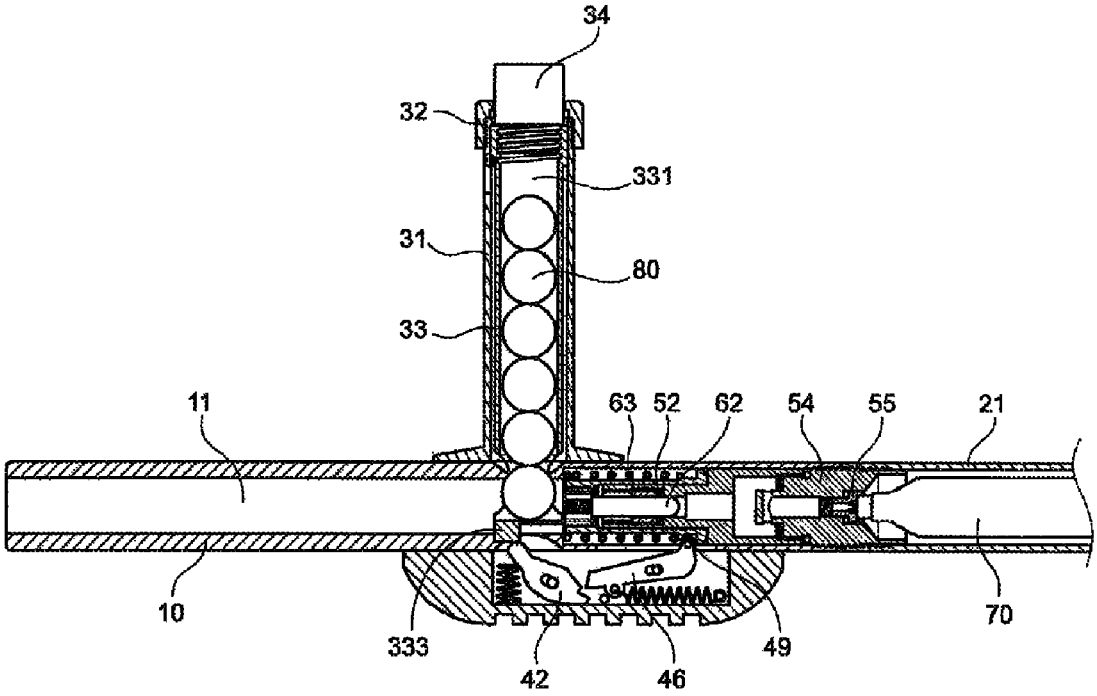
FIG. 9 is a sectional view of the present invention in a pressure-accumulated and ready-to-fire state.
Figure 10:
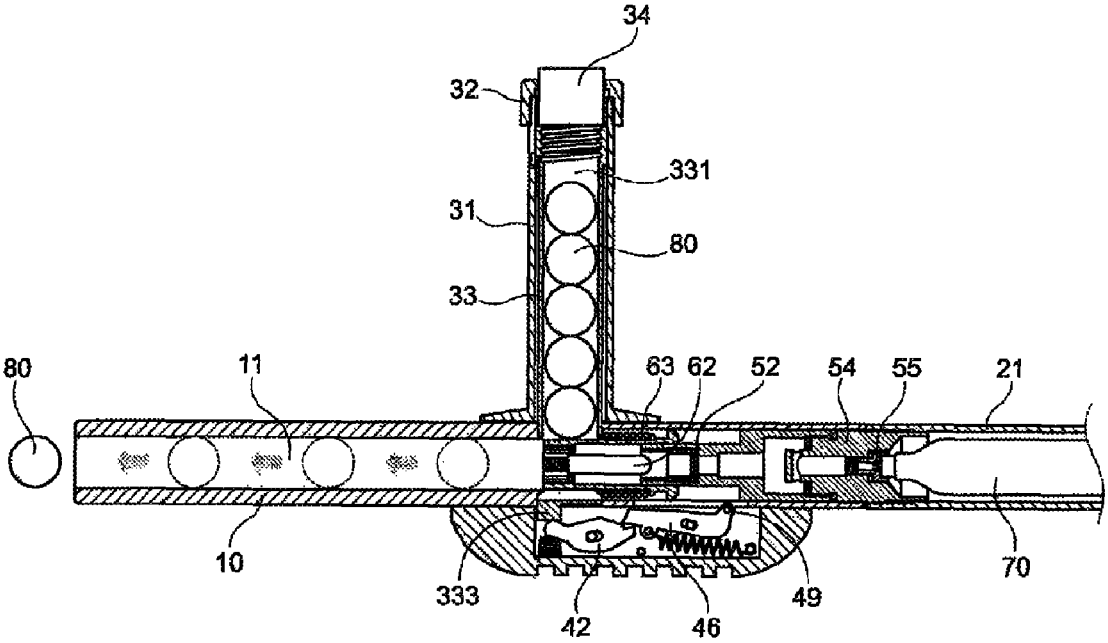
FIG. 10 is a sectional view of the present invention in a pressure-discharging and bullet-firing state.

The firing device of the present invention is assembled in the following manner. As shown in FIGS. 7 and 8, the C-shaped base 311 of the magazine portion 30 is installed above the through hole 12 of the first shaft portion 10. The trigger housing 40 is connected to the bottom side of the first shaft portion 10 at a position corresponding to the through hole 12 and the slot 16. The front section of the gas chamber body 51 of the gas chamber portion 50 is inserted into the through hole 612 of the nozzle 61 of the nozzle portion 60 such that the nozzle portion 60 and the gas chamber portion 50 are connected as a single-unit assembly. The single-unit assembly is inserted into the receiving hole 13 at the rear section of the first shaft portion 10 by engaging the external thread 548 of the gas chamber end cap 54 with the internal thread 15 at the rear end of the first shaft portion 10, and eventually the nozzle recoil spring 63 of the single-unit assembly is pressed against the shoulder 14 in the first shaft portion 10. In this state, the roller 49 of the sear 46 is engaged in the engaging groove 613 of the nozzle 61. Meanwhile, the external thread 548 of the gas chamber end cap 54 is half engaged with the internal thread 15 and half exposed at the rear end of the first shaft portion 10. Then, the shaft 21 of the second shaft portion 20 is connected to the rear end of the first shaft portion 10 by engagement between the internal thread 212 at the front end of the shaft 21 and the exposed portion of the external thread 548 of the gas chamber end cap 54. When the firing device of the present invention is put to practical use, a $CO_2$ cartridge 70 is placed into the shaft 21 from the rear end thereof. Then, the front rod 221 of the shaft cap 22 is inserted into the rear end of the shaft 21 and moved forward, thereby pushing the $CO_2$ cartridge 70 further into the shaft 21. After the external thread 222 of the front rod 221 is engaged with and moved relative to the internal thread 213 at the rear end of the shaft 21 by a certain distance, the fastening lever 224 bumps into the engaging grooves 214 on the rear end surface of the shaft 21 and is thus prevented from further rotation. To continue screwing the shaft cap 22 into the shaft 21, the fastening lever 224 is pressed and held in the pressed position, thereby lowering the front end of the fastening lever 224 into the slot 223 and allowing the fastening lever 224 to avoid contact with the engaging grooves 214. The pressing force applied to the fastening lever 224 is removed when the shaft cap 22 is almost completely inserted into the shaft 21, and in consequence the fastening lever 224 resumes its level position by virtue of the resilient force of the spring 225. Furthermore, while returning to the level position, the fastening lever 224 is engaged in one of the engaging grooves 214 that corresponds in position to the fastening lever 224. Thus, the fastening lever 224 is prevented from rotating or getting loose during operation, and safety in use is ensured. Moreover, once the shaft cap 22 is screwed in place (as shown in FIG. 9), the $CO_2$ cartridge 70 is pushed by the front rod 221 of the shaft cap 22 to a position where the sealed opening of the $CO_2$ cartridge 70 is punctured by the puncturer 55. As a result, the gas chamber portion 50 is filled with $CO_2$ gas and is thereby driven to push the nozzle portion 60 forward. Thus, not only is the rear end of the nozzle piston rod 62 inserted into the gaskets 52 of the gas chamber body 51 to create an airtight state in which the gas pressure is blocked by the airtight joint, but also the forward displacement of the nozzle 61 causes the engaging groove 613 to drive the roller 49 engaged therein, and consequently the sear 46, slightly forward such that the front end of the sear 46 is located right above the rear end of the trigger 42. Besides, as the roller 49 is engaged in the engaging groove 613, the forward movement of the nozzle 61 is restricted, so a pressure-accumulated and ready-to-fire state is reached. On the other hand, a user can unscrew the pushbutton 34, put a plurality of ball-shaped bullets 80 into the receiving hole 331 of the magazine body 33, and after the magazine body 33 is loaded, screw the pushbutton 34 back on to prevent the ball-shaped bullets 80 from falling off the magazine body 33. The ball-shaped bullets 80 in the magazine portion 30 will drop sequentially by their own weight to the through hole 332 at the lower end of the receiving hole 331. However, as the through hole 332 of the magazine body 33 is now offset with respect to the bore 11 of the first shaft portion 10, the ball-shaped bullets 80 will not fall into the bore 11. To fire the ball-shaped bullets 80, referring to FIG. 10, the user only has to hold the magazine seat 31 and press the pushbutton 34 with the thumb. As the pressed pushbutton 34 drives the magazine body 33 downward, the pushing block 333 of the magazine body 33 also pushes the trigger 42 downward. Consequently, the rear end of the trigger 42 is rotated upward about the pivot 43 and pushes the front end of the sear 46. In turn, the roller 49 provided above the rear end of the sear 46 is rotated downward about the pivot 45 and is thus disengaged from the engaging groove 613. At the meantime, the through hole 332 of the magazine body 33 is aligned with the bore 11 such that the lowest ball-shaped bullet 80 is positioned exactly in the bore 11. Now that the roller 49 is freed from the engaging groove 613, the nozzle 61 is no longer retained by the roller 49 and therefore moves forward, releasing the rod portion of the nozzle piston rod 62 from the airtight engagement with the gaskets 52. Then, all of a sudden, the accumulated pressure is discharged forward through the through hole 612 in the nozzle 61 and the plural channels 621 of the nozzle piston rod 62 and propels the ball-shaped bullet 80 in the bore 11 out of a front opening of the bore 11, thus completing the firing action. Once the accumulated pressure is discharged from the gas chamber portion 50, the force pushing the nozzle 61 forward is lost. The nozzle 61 is pushed back by the nozzle recoil spring 63 around the nozzle 61 until the rod portion of the nozzle piston rod 62 is inserted in the gaskets 52 of the gas chamber portion 50 again. Thus, the gas passage at the front end of the gas chamber body 51 is closed, bringing the gas chamber body 51 to a sealed state. As a result, the gas pressure accumulates once more to drive the nozzle portion 60 forward, causing the engaging groove 613 of the nozzle 61 to engage with the roller 49 of the sear 46. Hence, not only is the nozzle 61 prevented from moving further forward, but also the front end of the sear 46 is moved to the ready-to-fire position, i.e., above the rear end of the trigger 42. The pressure-accumulated and ready-to-fire state is reached again.

According to the above description, the intricate and ingeniously arranged components of the present invention are incorporated into an otherwise function-limited side-handle baton so that, in addition to serving defensive and body-strengthening purposes, the side-handle baton provides the fun of firing ball-shaped bullets. The structural design of the present invention also makes easy the replacement of $CO_2$ cartridges and the loading of ball-shaped bullets, thus increasing the practical value of the side-handle baton.

Figure 11:
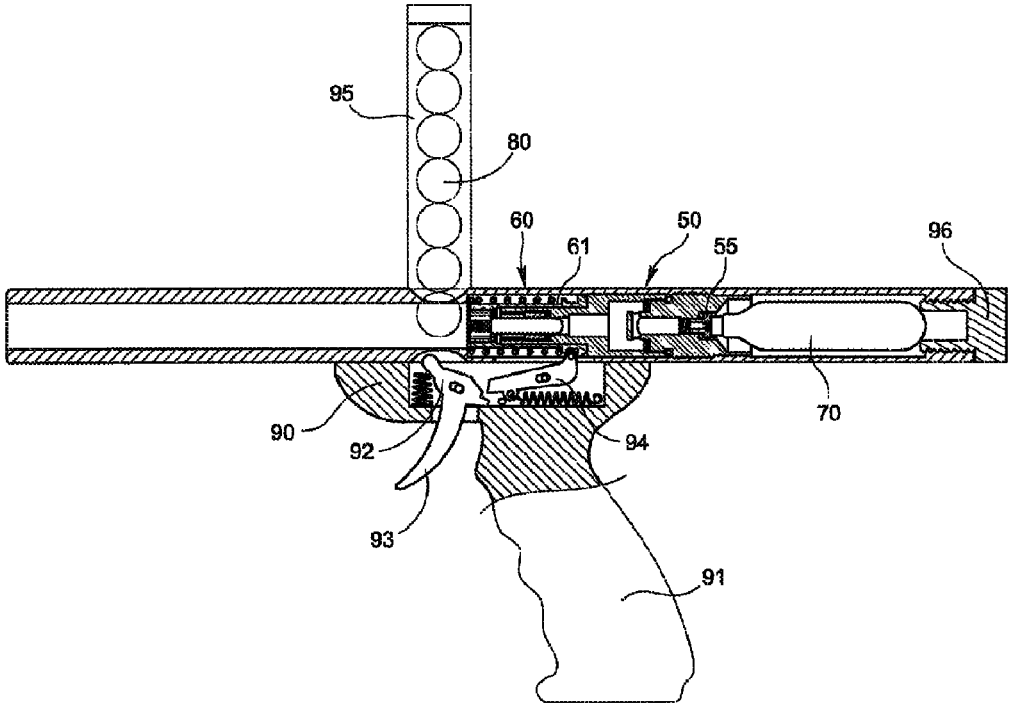
FIG. 11 shows the structure of the present invention applied to a toy gun.

Furthermore, the firing device of the present invention is applicable to objects other than side-handle batons. For instance, referring to FIG. 11, the present invention is integrated into the structure of a toy gun. As shown in the drawing, a handle 91 is connected to a bottom side of the trigger housing 90, and a curved portion 93 extends downward from a lower section of the trigger 92. Thus, a user can grasp the handle 91 and pull the curved portion 93 with the index finger so as to drive the trigger 92 and thereby drive the sear 94 to retain or release the nozzle portion 60. In addition, a bullet cartridge 95 is mounted at an appropriate position on the barrel of the toy gun. The bullet cartridge 95 allows the ball-shaped bullets 80 received therein to drop by their own weight to the bore of the barrel. The gas chamber portion 50 is located at a rear section of the barrel. The $CO_2$ cartridge 80 received in a rear part of the gas chamber portion 50 is pushed by a threaded cap 96 until the sealed opening of the $CO_2$ cartridge 80 is punctured by the puncturer 55. As a result, gas pressure begins to accumulate, and a pressure-accumulated and ready-to-fire state is eventually formed, in which state the user can pull the curved portion 93 of the trigger 92 with ease to release the nozzle 61 from the sear 94 and discharge the gas pressure forward through the nozzle portion 60, thereby firing the ball-shaped bullet 80 in the bore. After firing, the nozzle recoil spring 63 pushes the nozzle portion 60 back to its original position for pressure accumulation and thus prepares the toy gun for the next shot.

In short, according to the present invention, a novel and ingenious structure featuring easy operation, convenient replacement of $CO_2$ cartridges, and effortless loading of ball-shaped bullets is incorporated into the structure of a side-handle baton or a toy gun to substantially increase the fun of using the side-handle baton or toy gun. As the present invention has practical value and demonstrates non-obviousness as well as inventive steps, an application for patent of the present invention is hereby filed for examination.

What is claimed is:

1. A firing device of a side-handle baton, comprising:

a first shaft portion having a front section penetrated longitudinally by a bore and a rear section penetrated longitudinally by a receiving hole, wherein the receiving hole is connected with the bore, has a slightly larger diameter than the bore, thus forming a shoulder where the bore and the receiving hole are connected, and has a rear end wall provided with an internal thread, the first shaft portion being penetrated vertically by a through hole near the rear section, the first shaft portion further having a bottom side provided with a slot behind the through hole;

a second shaft portion comprising a shaft and a shaft cap, the shaft having a same outer diameter as the first shaft portion and being penetrated longitudinally by a passage, the passage having a front end wall and a rear end wall, wherein the front end wall is provided with an internal thread having same specifications as the internal thread of the first shaft portion, and the rear end wall is also provided with an internal thread, the shaft having a rear end surface formed with a plurality of angularly spaced engaging grooves; the shaft cap having an integrally formed front extension defined as a front rod for being inserted in the passage of the shaft, the front rod being provided with an external thread which is adjacent to the shaft cap and has same specifications as the internal thread at the rear end wall of the passage, the shaft cap having an upper side formed with a slot in which a fastening lever is pivotally provided, the fastening lever having a front end pushed by a spring so as to be constantly level with a slot surface of the slot of the shaft cap;

a magazine portion comprising: a magazine seat, a top cover, a magazine body, and a pushbutton; the magazine seat having a bottom portion formed as a C-shaped base, the magazine seat being penetrated longitudinally by a through hole and having an upper end which is provided with an external thread and is laterally provided with a slot at an appropriate position; the top cover being penetrated by a hollow portion and having a lower end provided with an internal thread having same specifications as the external thread at the upper end of the magazine seat, the top cover further having a through hole formed above and having a smaller diameter than the internal thread of the top cover; the magazine body being a cylindrical element penetrated longitudinally by a receiving hole, wherein the magazine body has: a lower end penetrated transversely by a transverse through hole, a bottom portion protrudingly provided with a pushing block, and an upper end which is laterally screwed with a stop screw and provided with an internal thread; the pushbutton having a button body whose outer diameter is slightly smaller than a diameter of the through hole of the top cover, the button body having a lower extension provided with an external thread having same specifications as the internal thread at the upper end of the magazine body; the magazine portion being assembled by: inserting the magazine body into the through hole of the magazine seat in such a way that the stop screw of the magazine body is aligned with the slot of the magazine seat, engaging the internal thread of the top cover with the external thread at the upper end of the magazine seat such that the top cover is connected to and covers the upper end of the magazine seat, and engaging the external thread of the pushbutton with the internal thread of the magazine body such that the pushbutton passes through the through hole of the top cover and is mounted on the upper end of the magazine body while the button body of the pushbutton is exposed outside the top cover;

a trigger housing internally formed with a recess, there being a trigger pivotally provided in a front portion of the recess via a pivot received in a slide groove passing through the trigger, wherein a pushing spring is fixedly provided below a front end of the trigger such that the front end of the trigger constantly rests on the pushing spring, there also being a sear pivotally provided in a rear portion of the recess via a pivot received in a slide groove passing through the sear, wherein an extension spring has an end connected to a bottom of a front end of the sear and an opposite end connected to a supporting rod in the recess, the sear having a rear upper end pivotally connected with a roller which, due to contraction of the extension spring, constantly juts out of the recess;

a gas chamber portion comprising: a gas chamber body, a plurality of gaskets, a gasket fixing member, a gas chamber end cap, and a puncturer; the gas chamber body being penetrated longitudinally by a hollow portion, wherein the hollow portion has: a front section provided with an internal thread, a gasket cavity adjacent to the internal thread of the front section, a through hole following the gasket cavity, and a rear end provided with an internal thread; the gaskets being annular washers received in the gasket cavity of the gas chamber body; the gasket fixing member being penetrated centrally and longitudinally by a hollow portion and having a front section provided with an external thread having same specifications as the internal thread on the front section of the hollow portion of the gas chamber body so as for the gasket fixing member to be screwed into the internally threaded front section of the hollow portion of the gas chamber body and thereby press tightly against and fix the gaskets in position; the gas chamber end cap being provided therein with a cavity, a puncturer hole, an internally threaded hole, and a front hole which are arranged in a rear-to-front direction and sequentially connected, wherein the front hole has a wall penetrated by a through hole for communication between an inside and an outside of the front hole, the gas chamber end cap having a front section provided with a first external thread having same specifications as the internal thread at the rear end of the hollow portion of the gas chamber body, there being a first O-ring mounted behind and adjacent to the first external thread on the front section of the gas chamber end cap, the gas chamber end cap being provided with a second external thread which is located immediately behind the first O-ring and has same specifications as the internal thread on the rear end wall of the receiving hole of the first shaft portion and the internal thread on the front end wall of the passage of the shaft, the gas chamber end cap being connected to a rear end of the gas chamber body by engagement between the first external thread on the front section of the gas chamber end cap and the internal thread at the rear end of the hollow portion of the gas chamber body; the puncturer being penetrated centrally by a hollow portion and having a front end provided with an external thread having same specifications as the internally threaded hole of the gas chamber end cap, there being a second O-ring mounted behind the external thread of the puncturer, the puncturer having a rear end surface provided with a conical piercing element, the puncturer being hermetically installed in the puncturer hole of the gas chamber end cap by engagement between the external thread of the puncturer and the internally threaded hole of the gas chamber end cap; and a nozzle portion comprising: a nozzle, a nozzle piston rod, and a nozzle recoil spring; the nozzle being penetrated longitudinally by a hollow portion and having: a front section provided with an internal thread, a rear section formed as a through hole extending to a rear end opening of the nozzle, and a rear end externally and circumferentially provided with an engaging groove; the nozzle piston rod having a front end, wherein the front end is provided with an external thread having same specifications as the internal thread on the front section of the nozzle and is peripherally formed with a plurality of channels, the nozzle piston rod further having a rod portion formed with a rounded rear end, the nozzle piston rod being installed in the nozzle by engagement between the external thread of the nozzle piston rod and the internal thread of the nozzle; the nozzle recoil spring having an inner diameter greater than an outer diameter of the front section of the nozzle so as to be mounted around the front section of the nozzle;

wherein the firing device is assembled by: installing the C-shaped base of the magazine portion above the through hole of the first shaft portion; connecting the trigger housing to the bottom side of the first shaft portion at a position corresponding to the through hole and the slot of the first shaft portion; inserting a front section of the gas chamber body of the gas chamber portion into the through hole of the nozzle of the nozzle portion such that the nozzle portion and the gas chamber portion are connected as a single-unit assembly; inserting the single-unit assembly into the receiving hole at the rear section of the first shaft portion by engagement between the second external thread of the gas chamber end cap and the internal thread on the rear end wall of the receiving hole of the first shaft portion until the nozzle recoil spring in the single-unit assembly is pressed against the shoulder in the first shaft portion, in which state the roller of the sear is engaged in the engaging groove of the nozzle while the second external thread of the gas chamber end cap is half engaged with the internal thread on the rear end wall of the receiving hole of the first shaft portion and half exposed at a rear end of the first shaft portion; connecting the shaft of the second shaft portion to the rear end of the first shaft portion by engagement between the internal thread on the front end wall of the passage of the shaft and the exposed portion of the second external thread of the gas chamber end cap; placing a $CO_2$ cartridge into the shaft from a rear end thereof; inserting the front rod of the shaft cap into the rear end of the shaft and moving the front rod forward to push the $CO_2$ cartridge further into the shaft such that, when the front rod is almost completely screwed into the shaft, the $CO_2$ cartridge is pushed to a position where a sealed opening of the $CO_2$ cartridge is punctured by the puncturer; and unscrewing the pushbutton, loading a plurality of ball-shaped bullets into the receiving hole of the magazine body, and screwing the pushbutton back on after the loading, such that the ball-shaped bullets in the magazine portion drop sequentially by their own weight to the transverse through hole at a lower end of the receiving hole of the magazine body and are ready to be fired.

2. The firing device of claim 1, wherein the firing device is applied to a toy gun, the trigger housing having a bottom side connected with a handle, the trigger having a lower section extended downward with a curved portion, such that a user can grasp the handle and pull the curved portion with an index finger so as to drive the trigger and thereby drive the sear to retain or release the nozzle portion, the toy gun having a barrel mounted with a bullet cartridge at an appropriate position, the bullet cartridge allowing the ball-shaped bullets received therein to drop by their own weight to the bore, the gas chamber portion being located at a rear section of the barrel, the $CO_2$ cartridge received in a rear part of the gas chamber portion being pushed by a threaded cap until the sealed opening of the $CO_2$ cartridge is punctured by the puncturer to begin accumulation of gas pressure and form a pressure-accumulated and ready-to-fire state.

* * * * *